US007091162B2

(12) United States Patent
Lewis et al.

(10) Patent No.: US 7,091,162 B2
(45) Date of Patent: Aug. 15, 2006

(54) CURED LUBRICANT FOR CONTAINER COVEYORS

(75) Inventors: Paul F. Lewis, Lake Geneva, WI (US); Jim J. Hilarides, Lebanon, OH (US)

(73) Assignee: JohnsonDiversey, Inc., Sturtevant, WI (US)

( * ) Notice: Subject to any disclaimer, the term of this patent is extended or adjusted under 35 U.S.C. 154(b) by 85 days.

(21) Appl. No.: 10/613,504

(22) Filed: Jul. 3, 2003

(65) Prior Publication Data

US 2005/0003973 A1 Jan. 6, 2005

(51) Int. Cl.
*C10M 107/28* (2006.01)
*C10M 111/04* (2006.01)
*B65G 45/02* (2006.01)

(52) U.S. Cl. ..... 508/165; 508/451; 508/472; 508/507; 508/590; 427/372.2; 427/385.5; 427/424; 198/500

(58) Field of Classification Search ..... 508/451, 508/470, 472, 513, 590, 165
See application file for complete search history.

(56) References Cited

U.S. PATENT DOCUMENTS

| | | | |
|---|---|---|---|
| 2,813,045 | A | 11/1957 | Abbott, Jr. |
| 2,830,721 | A | 4/1958 | Pinsky et al. |
| 2,833,718 | A | 5/1958 | Morway et al. |
| 2,836,318 | A | 5/1958 | Pinsky et al. |
| 2,836,319 | A | 5/1958 | Pinsky et al. |
| 2,860,801 | A | 11/1958 | Nielsen |
| 2,985,542 | A | 5/1961 | Pinsky et al. |
| 2,995,534 | A | 8/1961 | Adams et al. |
| 3,060,057 | A | 10/1962 | Johnson |
| 3,108,018 | A | 10/1963 | Lewis |
| 3,264,272 | A | 8/1966 | Rees |
| 3,279,940 | A | 10/1966 | Francis et al. |
| 3,282,729 | A | 11/1966 | Richardson et al. |
| 3,323,889 | A | 6/1967 | Carl et al. |
| 3,362,843 | A | 1/1968 | Smith et al. |
| 3,415,673 | A | 12/1968 | Clock |
| 3,438,801 | A | 4/1969 | Schlientz et al. |
| 3,445,275 | A | 5/1969 | Bogart |
| 3,525,636 | A | 8/1970 | Bogart |
| 3,604,584 | A | 9/1971 | Shank, Jr. |
| 3,713,867 | A | 1/1973 | Parkinson et al. |
| 3,743,491 | A | 7/1973 | Poole et al. |
| 3,823,032 | A | 7/1974 | Ukai |
| 3,864,151 | A | 2/1975 | Shonebarger et al. |
| 3,915,870 | A | 10/1975 | Brown |
| 3,937,676 | A | 2/1976 | Shonebarger et al. |
| 3,984,608 | A | 10/1976 | Opitz |
| 3,997,693 | A | 12/1976 | Kircher |
| 3,998,986 | A | 12/1976 | Williams |
| 4,039,337 | A | 8/1977 | Brown et al. |
| 4,053,076 | A | 10/1977 | Vogel et al. |

(Continued)

FOREIGN PATENT DOCUMENTS

| | | |
|---|---|---|
| GB | 1 564 128 | 4/1980 |

(Continued)

OTHER PUBLICATIONS

PCT International Search Report dated Mar. 28, 2005.

*Primary Examiner*—Ellen M. McAvoy
(74) *Attorney, Agent, or Firm*—Foley & Lardner LLP

(57) ABSTRACT

Lubricants for containers and for conveyors for transporting containers are provided. The lubricants provide container and conveyor surfaces having low coefficients of friction. In one embodiment, the lubricants comprise a cured coating containing hydrophobic polymers and waxes.

32 Claims, 3 Drawing Sheets

U.S. PATENT DOCUMENTS

| | | | |
|---|---|---|---|
| 4,093,759 | A | 6/1978 | Otsuki et al. |
| 4,131,552 | A | 12/1978 | Marcantonio |
| 4,143,181 | A | 3/1979 | Cahn et al. |
| 4,163,812 | A | 8/1979 | Coucher |
| 4,246,313 | A | 1/1981 | Stengle, Jr. |
| 4,264,350 | A | 4/1981 | Thomas |
| 4,316,930 | A | 2/1982 | Stengle, Jr. |
| 4,343,641 | A | 8/1982 | Scholes |
| 4,382,998 | A | 5/1983 | Stengle, Jr. et al. |
| 4,387,551 | A | 6/1983 | Cowan |
| 4,393,106 | A | 7/1983 | Maruhashi et al. |
| 4,409,266 | A | 10/1983 | Wieczorrek et al. |
| 4,420,578 | A | 12/1983 | Hagens et al. |
| 4,471,016 | A | 9/1984 | Scholes |
| 4,486,378 | A | 12/1984 | Hirata et al. |
| 4,521,321 | A | 6/1985 | Anderson et al. |
| 4,569,869 | A | 2/1986 | Kushida et al. |
| 4,809,640 | A | 3/1989 | Pilley, et al. |
| 4,818,571 | A | 4/1989 | Pilley, et al. |
| 4,822,646 | A | 4/1989 | Clark et al. |
| 4,891,241 | A | 1/1990 | Hashimoto et al. |
| 5,043,380 | A | 8/1991 | Cole |
| 5,073,280 | A | 12/1991 | Rossio et al. |
| 5,139,834 | A | 8/1992 | Cole |
| 5,290,828 | A | 3/1994 | Craun et al. |
| 5,300,334 | A | 4/1994 | Niederst et al. |
| 5,300,541 | A | 4/1994 | Nugent, Jr. et al. |
| 5,318,808 | A | 6/1994 | Crivello et al. |
| 5,324,546 | A | 6/1994 | Crutchley |
| 5,334,322 | A | 8/1994 | Williams, Jr. |
| 5,385,764 | A | 1/1995 | Andersen et al. |
| 5,453,310 | A | 9/1995 | Andersen et al. |
| 5,489,455 | A | 2/1996 | Nugent, Jr. et al. |
| 5,491,204 | A | 2/1996 | Nugent, Jr. et al. |
| 5,514,430 | A | 5/1996 | Andersen et al. |
| 5,559,087 | A | 9/1996 | Halsrud et al. |
| 5,573,819 | A | 11/1996 | Nugent, Jr. et al. |
| 5,580,410 | A | 12/1996 | Johnston |
| 5,637,365 | A | 6/1997 | Carlblom |
| 5,681,628 | A | 10/1997 | Niederst et al. |
| 5,686,188 | A | 11/1997 | Brandt et al. |
| 5,747,431 | A | 5/1998 | Taylour et al. |
| 5,900,392 | A | 5/1999 | Bernhard |
| 5,925,601 | A | 7/1999 | McSherry et al. |
| 5,932,649 | A | 8/1999 | Hergenrother et al. |
| 5,935,914 | A | 8/1999 | Theyssen et al. |
| 6,013,333 | A | 1/2000 | Carson et al. |
| 6,214,777 | B1 | 4/2001 | Li et al. |
| 6,321,903 | B1 | 11/2001 | Shaffer |
| 6,409,813 | B1 | 6/2002 | Beesabathina et al. |
| 6,485,794 | B1 | 11/2002 | Li et al. |
| 2002/0051850 | A1* | 5/2002 | Bennett et al. ..... 427/421 |
| 2003/0118744 | A1* | 6/2003 | Li et al. ..... 427/512 |

FOREIGN PATENT DOCUMENTS

| | | |
|---|---|---|
| WO | WO 90/05031 | 5/1990 |
| WO | WO 90/05088 | 5/1990 |
| WO | WO 92/19505 | 11/1992 |
| WO | WO 98/51746 | 11/1998 |
| WO | WO 00/43049 | 7/2000 |

* cited by examiner

CURED LUBRICANT FOR CONTAINER COVEYORS

FIELD OF THE INVENTION

The present invention relates to lubricants for containers and for conveyors for transporting containers. More particularly, the present invention concerns the use of cured conveyor and container lubricants containing hydrophobic polymers and waxes.

BACKGROUND OF THE INVENTION

In many areas of manufacturing, including drink bottling and food processing plants, conveyors are used to move containers such as bottles, jars, cans, and the like between locations. In order to maintain line efficiency, keep the containers and conveyor parts clean, and provide lubrication it is customary to use a lubricant, typically an aqueous, soap-based or synthetic lubricant. These lubricants are generally sold as concentrates designed to be heavily diluted prior to or during use. For example, a typical dilution ratio might be 1:100 or even greater.

Unfortunately, these conventional lubricants present certain disadvantages. For example, due to the heavy dilution, these lubricants tend to drip from the surfaces onto which they are coated, creating a safety hazard in plants and requiring constant clean-up efforts. In addition, the conventional lubricants typically require frequent or constant reapplication which adds to the cost and inefficiency of the lubricating process. Known lubricants are frequently incompatible with containers and/or conveyor parts. For example, many commercially available lubricants cause stress cracking in polyethylene terephthalate bottles.

Thus a need exists for a container and conveyor lubricant that is cost effective and efficient to apply and reapply, and is compatible with containers and conveyor parts.

SUMMARY OF THE INVENTION

The present invention provides lubricants for containers and for the conveyors on which the containers are transported, methods for applying the lubricants to containers and conveyors, and conveyors and containers coated with the lubricants. The cured lubricating coatings provided by the invention provide container and conveyor surfaces having very low coefficients of friction, in some instances coefficients of friction lower than 0.15. In addition to lubrication, the cured coatings provide wear resistance to the conveyor parts or containers and are easily repaired by subsequent coating applications. In some embodiments, the lubricants are cured coatings containing at least one hydrophobic polymer and at least one wax.

One aspect of the invention provides a method for lubricating a container or a conveyor for transporting a container by applying a curable composition to at least a portion of the container or at least a portion of a conveyor part and non-thermally and non-radiatively curing the composition to form a cured substantially water-repellant lubricating coating on at least a portion of the container or conveyor part. The curable composition is characterized in that it includes at least one hydrophobic polymer and at least one wax.

Another aspect of the invention provides a method for lubricating a container or a conveyor for transporting a container by applying a curable composition to at least a portion of the container or at least a part of the conveyor and non-thermally and non-radiatively curing the composition to form a cured substantially water-repellent lubricating coating on at least a portion of the container or the conveyor wherein the cured coating as applied has a coefficient of friction of less than 0.15.

Yet another aspect of the invention provides a method for lubricating a container or a conveyor for transporting a container by applying a curable composition to at least a portion of the container or at least a portion of a conveyor part and curing the composition to form a cured lubricating coating on at least a portion of the container or conveyor wherein the curable composition comprises an alkali soluble resin, at least one additional hydrophobic polymer and at least one wax.

DETAILED DESCRIPTION OF THE PREFERRED EMBODIMENTS

Figure 1:
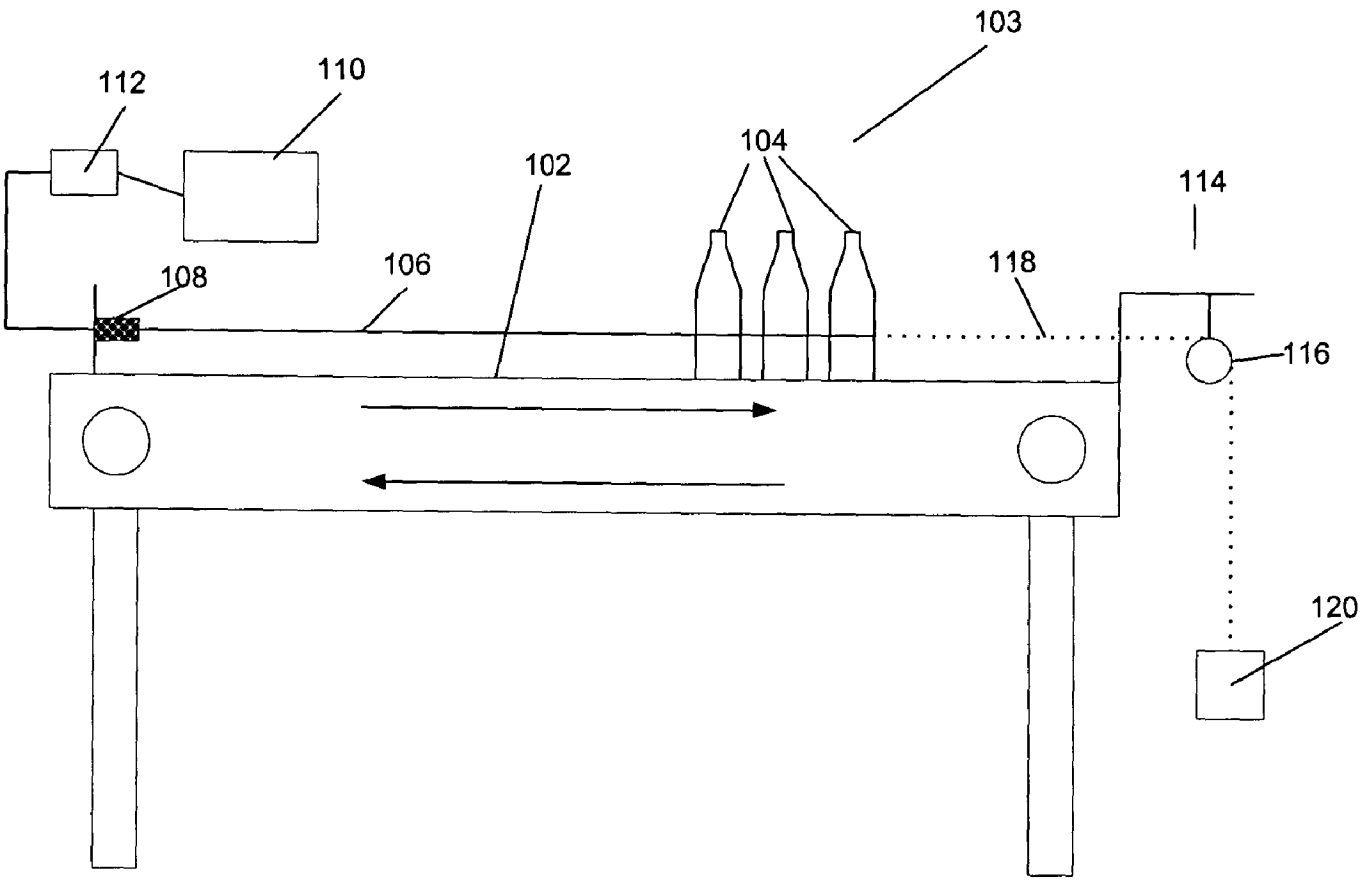
FIG. 1 shows the laboratory conveyor setup used to obtain coefficient of friction values for the cured lubricating coatings using the short track conveyor test.

In accordance with the present invention, cured conveyor and container lubricants having very low coefficients of friction are prepared from various hydrophobic polymers. In some embodiments, the cured lubricant coatings provide a coefficient of friction of no more than 0.15, as measured by a short track conveyor test. In addition to the hydrophobic polymer, the conveyor or container lubricants may also include at least one wax. The lubricants are applied to at least a portion of a container or at least a portion of a part of a conveyor for transporting containers in the form of a curable composition which is subsequently cured to produce a cured substantially water-repellent lubricating coating on at least a portion of the container or conveyor part. The cure is desirably a non-thermal and non-radiative cure.

For the purposes of this invention, the term "cured" is used broadly to include any process wherein a substantially liquid composition goes from a substantially liquid state to a solid or semi-solid state. Thus a cured coating is a coating that has been solidified, dried, polymerized or otherwise hardened into a solid-like coating. A composition is non-thermally cured when curing takes place at room temperature without the use of any additional heating sources, such as heaters, ovens, infrared lamps, or microwave sources. A composition is non-radiatively cured when curing takes place at ambient room lighting conditions without the use of additional radiation sources such as ultraviolet lamps, infrared lamps, x-ray, or gamma-ray sources. The ability to produce a cured lubricating coating without thermal or radiative curing represents a significant advance because it reduces the need for expensive and bulky processing equipment, thereby reducing processing costs and inefficiencies.

As used herein, the phrase "substantially water-repellent" means the coatings have sufficient hydrophobic character such that they do not absorb or become swollen by water or other hydrophilic liquids to any significant extent. As such, the inherent lubricity properties of the lubricating coatings provided herein are not affected by contact with water or other hydrophilic liquids with which the coating might come into contact during use. As one of skill in the art would recognize, it is possible that the apparent lubricating properties of the coatings could be affected by the application of water or other hydrophilic liquids to the surface of the coating through hydroplaning effects. However, such effects would not constitute a change in the inherent lubricating properties of the coating itself. In general, the cured coatings will be free of or substantially free of poly(N-vinyl lactams) and polyacrylamides.

The cured lubricants of the present invention have several advantages in comparison to other conveyor and container lubricants presently available. First, the cured lubricants provide a lubricated surface in the substantial absence of water. This saves the time and expense associated with the need to constantly reapply water-based lubricants to a conveyor system and eliminates the problems associated with lubricant dripping from a conveyor system onto a floor. As cured coatings, the lubricants are easily renewed and repaired by simply reapplying the lubricant compositions to worn or damaged portions of the containers or conveyors. Finally, in embodiments where the cured coatings are non-UV-curable coatings, the use of toxic starting materials which are commonly associated with UV-curable materials is avoided.

The lubricating coatings may be applied to any conveyor-contacting surface of a container to be transported on a conveyor or any container-contacting portion of a conveyor part. Parts of a conveyor system that may be partially or wholly coated with lubricating coatings include any part that has the potential to impede the movement of a container along the conveyor. Examples of suitable parts include, but are not limited to, conveyor belts, tracks, chains, and chute guides. These conveyor parts may be made of a variety of materials including plastics and metals. In one embodiment, the lubricating coatings are applied to stainless steel conveyor parts. The containers that may be lubricated with the cured coatings of the present invention include, but are not limited to, plastic, glass, paper, metal, and ceramic containers. Unlike many water-based lubricants, the cured coatings presented herein are not reactive toward common container materials. For example, the cured coatings do not cause stress-cracking in PET bottles.

The cured lubricating coatings contain at least one hydrophobic polymer which desirably requires no thermal or radiative cure. The hydrophobic polymer may be any polymer capable of rendering a substantially water-repellent surface, having a reduced coefficient of friction either by itself or in combination with a wax. Many suitable hydrophobic polymers are known and commercially available. These polymers may be of the type known as thermoplastic or thermosetting. Thermoplastic polymers include, but are not limited to, polyurethane dispersions, silicones, fluorinated polymers, polyesters, and acrylics (homo- or copolymers with other monomers, such as styrene).

Acrylic polymers are particularly well suited for use in the coatings. These acrylic polymers may include a broad range of polymers made from various reactive monomers. Suitable monomers include, but are not limited to, acrylate and methacrylate monomers, such as butyl acrylate and methyl methacrylate. Polymers suitable for this invention may also include acrylic copolymers, where the acrylic can be modified by monomers such as vinyl acetate, styrene or vinyl chloride. Some examples of a modified acrylic hydrophobic polymer in the coatings of the present invention include C-41 Polymer Emulsion & B-98 Alkali Soluble Resin. The formulations for these polymers are presented in Tables 1 and 2 below.

TABLE 1

C-41 Polymer

| COMPONENT | AMOUNT (WEIGHT PERCENT) |
|---|---|
| Deionized Water | 62.8 |
| Styrene | 11.9 |
| Butyl Acrylate | 11.2 |
| Methacrylic Acid | 4.4 |
| Alpha Methyl Styrene | 4.1 |
| Anionic Surfactant | 3.0 |
| Methyl Methacrylate | 2.4 |
| Ammonium Persulfate | 0.2 |
| TOTAL | 100.0 |

TABLE 2

B-98 Alkali-Soluble Resin

| COMPONENT | AMOUNT |
|---|---|
| Styrene | 28.3 |
| Acrylic Acid | 24.4 |
| Alpha Methyl Styrene | 34.3 |
| Di-tertiary Butyl Peroxide | 2.0 |
| Diethylene Glycol Ethylether | 1.5 |
| Diethylene Ethylether Acrylate | 9.5 |
| TOTAL | 100.0 |

Alkali-soluble resins (ASR) made from copolymers of monomers such as styrene, acrylic acids and alpha-methyl styrene are a type of polymer that are desirably used as the hydrophobic component of the lubricating coatings. In some embodiments, the acid number of the ASR will be from about 75 to about 500 and the number average molecular weight of the ASR will be less than about 20,000. For example, in some coatings the ASR may have a number average molecular weight from about 500 to 20,000. The inclusion of these low molecular weight ASRs in the lubricating coatings may be advantageous because they help to expedite coating drying. It has been discovered that a mixture of an ASR with a higher molecular weight polymer emulsion (i.e. having a number average molecular weight of at least about 30,000, desirably at least about 40,000, or even at least about 50,000), is particularly well-suited for producing a fast drying, highly durable, lubricating coating with a low coefficient of friction. In these mixed ASR: polymer coatings, the ratio of ASR:polymer on a solids:solids basis may range from about 99.9:0.1 to 0.1:99.9. This includes embodiments where the ASR:polymer ratio on a solids: solids basis is from about 90:10 to 10:90, further includes embodiment where the ASR:polymer ratio on a solids:solids basis is from about 70:30 to 30:70, still further includes embodiments where the ASR:polymer ratio on a solids: solids basis is from about 60:40 to 40:60 and even further includes embodiments where the ASR:polymer ratio on a solids:solids basis is from about 45:55 to 55:45.

Examples of fluorinated polymers found to be effective as the hydrophobic polymers in the lubricating coatings include Hylar Latex 932, a polyvinylidene fluoride emulsion or Algoflon D3105, a polytetrafluoroethylene emulsion, both from Solvay Solexis, Thorofare, N.J.

Thermosetting polymers for use as the hydrophobic polymers in the lubricating coatings may include, but are not limited to, two component epoxy resins, two component polyurethanes and polyurethane dispersions which undergo an oxidative curing mechanism, requiring no thermal or radiative curing. An example of an oxidative-curing polyurethane dispersion is Neorez R9403, supplied by Neoresins, Wilmington, Mass.

The amount of hydrophobic polymer in the cured coating may vary. In certain embodiments the coating comprises at least 40 weight percent hydrophobic polymer based on the solids content of the cured coating. This includes embodiments where the coating comprises at least 75 weight percent hydrophobic polymer based on the solids content of the cured coating and further includes embodiments where the coating comprises at least 90 weight percent hydrophobic polymer based on the solids content of the cured coating. In other embodiments, the cured coating may include substantially less hydrophobic polymer. For example, the coating may include less than 30 weight percent hydrophobic polymer based on the solids content of the cured coating, or even less than 20 weight percent hydrophobic polymer based on the solids content of the cured coating.

It is desirable to combine at least one hydrophobic polymer with at least one wax in the cured lubricating coatings. A variety of natural and synthetic waxes may be used in lubricating coatings. Specific examples of suitable waxes include, but are not limited to, camauba wax, olefin waxes, polytetrafluoroethylene (PTFE) waxes, polyethylene-based waxes, polypropylene-based waxes, paraffinic waxes and synthetic waxes, based on, for example, ethylene/acrylic acids. Suitable commercially available synthetic waxes include, but are not limited to, AC 540, AC 3105 and AC 392, all of which are available from Honeywell, Inc, Honeywell, N.J. A suitable camauba wax may be purchased from Lubrizol under the tradename Aquaslip 952.

The relative amount of wax in the cured coatings of the present invention may vary over a wide range depending on a variety of factors including the nature of the hydrophobic polymer used, the nature of the surface to be coated, and the desired degree of lubricity. In various embodiments the wax makes up at least 5 wt. % of the cured coating based on the solid material content of the coating. This includes embodiments wherein the wax accounts for at least 10 wt. %. In other embodiments the wax makes up a considerably higher percentage of the lubricating coating. For example, in some embodiments the wax makes up at least 20 wt. % based on the solid material content of the coating. This includes embodiments where the wax makes up at least 40 wt. % based on the solid material content of the coating, further includes embodiments where the wax makes up at least 50 wt. % based on the solid material content of the coating, still further includes embodiments where the wax makes up at least 55 wt. % based on the solid material content of the coating and even further includes embodiments where the wax makes up at least 60 wt. % based on the solid material content of the coating. The ratio of hydrophobic polymer to wax in the wax-containing coatings may range from 5:95 to 95:5, desirably 10:90 to 90:10.

The hydrophobic polymers and any waxes that make up the cured lubricating coatings may be applied to the containers or conveyors in the form of a liquid composition which is contacted with the container or conveyor through any of a variety of well-known application methods. For example, the compositions may be applied by spray coating, drip coating, roll coating, or application by a brush, cloth or sponge. The liquid may be an aqueous solution, dispersion or emulsion. Alternatively, organic solvents may be used to produce the solution. However, for environmental reasons, aqueous liquids will typically be preferred. The compositions may be applied in neat form, that is, without additional dilution, to the surface of the conveyor part or container. Alternatively, the compositions may be diluted to an appropriate extent to facilitate application to the surface of the conveyor part or container.

In addition to the at least one hydrophobic polymer and the at least one wax, the lubricating coatings of the present invention may contain other additives commonly found in container and conveyor lubricants and coatings. Suitable additives include, but are not limited to, anti-microbial agents, pigments, surfactants, wetting agents, defoaming agents and durability enhancers, such as zinc oxide. The cured lubricant coatings of the present invention reduce the coefficients of friction of the surfaces to which they are applied. The lubricating coatings are capable of providing coefficients of friction of no more than 0.16 as measured using a short track conveyor test. This includes embodiments where the lubricating coatings, as applied, provide a surface having a coefficient of friction of no more than 0.15, further includes embodiments where the coefficient of friction is no more than 0.14, still further includes embodiments where the lubricating coatings, as applied, provide surfaces having a coefficient friction of no more than 0.13, even further includes embodiments where the lubricating coatings, as applied, provide surfaces having a coefficient of friction of no more than 0.12, yet further includes embodiments where the lubricating coatings, as applied, provide surfaces having a coefficient of friction of no more than 0.11 and even further includes embodiments where the lubricating coatings, as applied, provide surfaces having a coefficient of friction of no more than 0.1. The phrase "as applied" as used herein is used to refer to the lubricating coatings after they have been cured on the surface of a container or a conveyor but prior to any contact with water or any other polar liquid which might produce hydroplaning effects. The short track conveyor test used to obtain the coefficient of friction values for the solid lubricating coatings is described in detail in the examples section below.

EXAMPLES

Example 1

Cured Lubricant Containing Acrylic Polymers

An exemplary acrylic lubricant formulation containing a mixture of a polymeric emulsion, an alkali soluble resin, and a carnauba wax is presented in this example. The formulation for the composition used to produce the lubricating coating is provided in Table 3.

TABLE 3

| Ingredient | Weight Percent (Total) | Percent Solids |
|---|---|---|
| Water | 59.8 | — |
| Diethyleneglycol ethyl ether | 2.72 | — |
| Zonyl FSE Fluorosurfactant | 0.11 | 0.02 |
| Aquaslip 952 Wax Emulsion | 21.75 | 5.44 |
| Ammonium Hydroxide | 0.27 | — |
| B-98 Resin Solution | 8.97 | 2.50 |
| C-41 Polymer Emulsion | 5.44 | 1.90 |
| Zinc Ammonium Carbonate Solution | 0.92 | 0.14 |
| SE 21 Defoamer[a] | 0.01 | — |
| TOTAL | 100.00 | 10.00 |

[a]SE 21 is a defoamer commercially available from Wacker Chemical Corp., Mount Laurel, N.J.

The coefficient of friction for a set of sample bottles traveling on a conveyor belt coated with the formulation of Table 3 was measured. The apparatus used to measure the coefficient of friction is shown in FIG. 1. The composition was applied to a clean short track conveyor belt using a manual spray bottle and cured. The composition was applied in an amount of about 1.2 to 2.2 mg/cm$^2$ until approximately 8 grams of the composition had been applied. The composition was then allowed to cure for about 20 minutes until dry to the touch. The coefficient of friction for bottles traveling on a conveyor belt having a cured lubricant coating thereon was tested using a short track conveyor test. The short track conveyor test was conducted as follows. Each lubricant composition was applied onto a motor driven laboratory table top conveyor belt 102, as shown in FIG. 1. The laboratory table top conveyor system 103 was a 71f2" SS815 stainless steel conveyor from Simplimatic Engineering, 6'0" long, with adjustable guide rails (not shown), casters (not shown) and Top Conveyor 3i4 HP variable speed drive (not shown), including stainless steel drip pan (not shown) measuring 12" wide by 6'6" long. After application of the lubricant composition to the conveyor belt, the composition was allowed to cure at room temperature under ambient conditions until a cured solid coating resulted. Six 12 oz. long-neck glass beer bottles 104 were placed on the conveyor and held stationary as the conveyor was allowed to run at a speed of 1.35 meters/second. The conveyor was started and the six bottles 104 were placed onto the surface one by one into a load cell loop 106 connected to a strain gage load cell 108 (model no. 363-D3-50-20pl from Process Instrument and Valves, Inc.). The load cell was interfaced with a digital indicator 112 (model IMS from Process Instruments and Valves, Inc.) and calibrated at regular intervals following the standard instructions provided with the meter. A calibration jig may be used to calibrate the load cell. The calibration jig 114 is an apparatus that suspends a low friction pulley (4") 116 off the back of the conveyor. Small gage calibration wire or cable 118 (of negligible mass) is secured to the load cell 108 and draped over the pulley 116. A weight 120 is secured to the opposite end during the calibration of the load cell 108. The total weight of the bottles 104 and the load cell loop 106 was about 2854 grams. The conveyor with the bottles was allowed to run for 30 minutes while drag levels were recorded. The drag levels may be read manually or may be read from a strip chart recorder 110 (model BD 40 from Kipp-Zonen). After 30 minutes a final drag reading was recorded.

Once the dry run measurements were completed, the coated conveyor was sprayed with tap water from a 32 oz. trigger sprayer to wet the conveyor surface for two minutes at approximately 115 grams/minute. The conveyor was then run with the test bottles in place and coefficient of friction measurements were taken over a period of about 30 minutes, during which the conveyor was allowed to air dry. The results of these "wet" runs demonstrated that the conveyor coatings were able to recover their low coefficient of friction values once the coatings have dried.

The lubricity of a particular lubricant was measured as the bottle drag in the horizontal plane divided by a known load in the vertical plane. Coefficient of friction values were measured using dry coatings and coatings that had been exposed to water. The coefficient of friction was used to measure the lubricity of the conveyor. To obtain this measurement, the final drag measurement was converted to a coefficient of friction (COF) measurement using the following calculation:

$$COF = \frac{\text{drag in the horizontal plane (from load cell)}}{\text{total bottle weight}}$$

Figure 2:
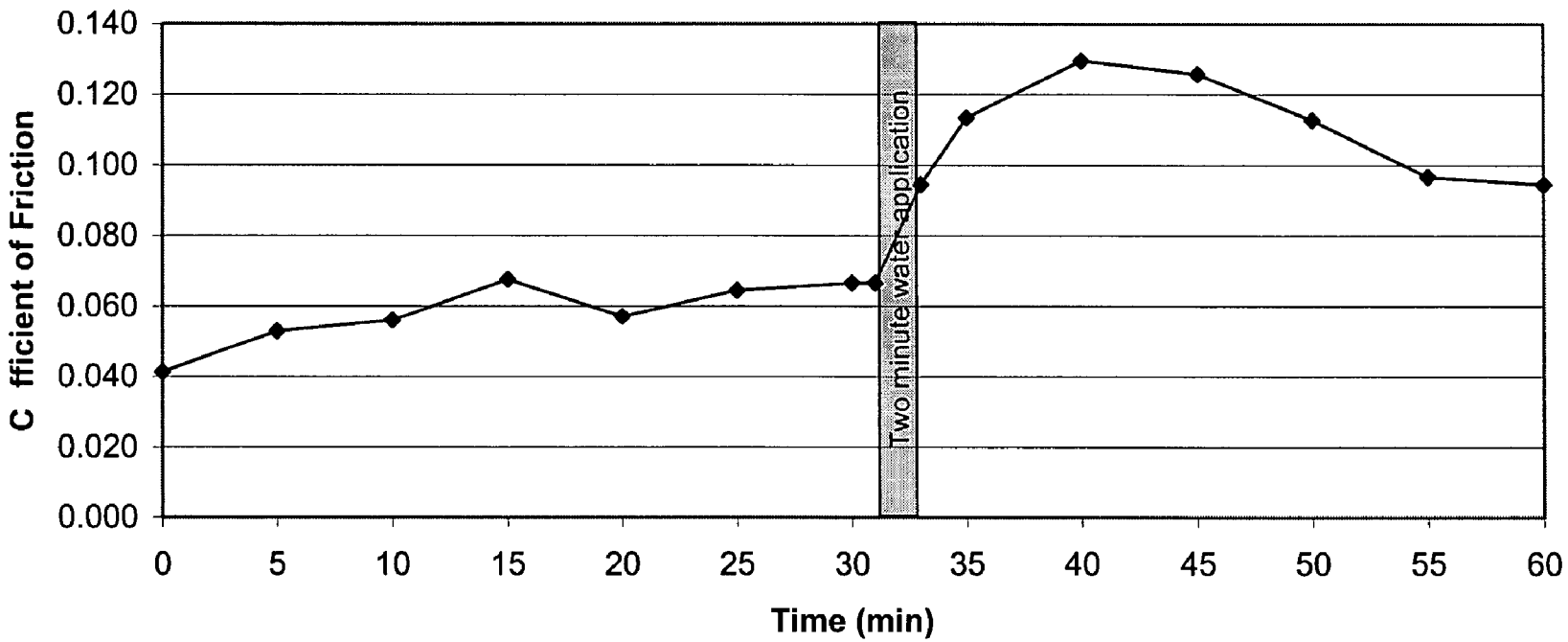
FIG. 2 shows a graph of the coefficient of friction versus time, measured according to the short track conveyor test, for the formulation of Example 1.

As shown in FIG. 2, the coefficient of friction measurements for the cured lubricating coating made from the formulation of Table 3 ranged from about 0.04 to about 0.07 under dry conditions and from about 0.07 to about 0.13 under wet conditions.

Example 2

Cured Lubricant Containing a Polyurethane

A polyurethane-based lubricant was produced by combining the ingredients in Table 4 in the order shown.

TABLE 4

| Ingredient | Weight Percent (Total) | Percent Solids |
|---|---|---|
| Water | 63.69 | — |
| Licowet F3[b] | 0.01 | — |
| Neorez R 9403[c] | 16.2 | 5.02 |
| Aguaslip 952 | 20.08 | 5.02 |
| Byk 024[d] | 0.03 | 0.03 |
| TOTAL | 100.0 | 10.07 |

[b]Licowet F3 is a fluoroalkyl sulfonate salt solution available from Clariant Corp., Charlotte, N.C.
[c]Neorez R 9403 is a polyurethane dispersion from Neoresin Corp.
[d]Byk 024 is a defoamer from Byk Chemie Company.

Figure 3:
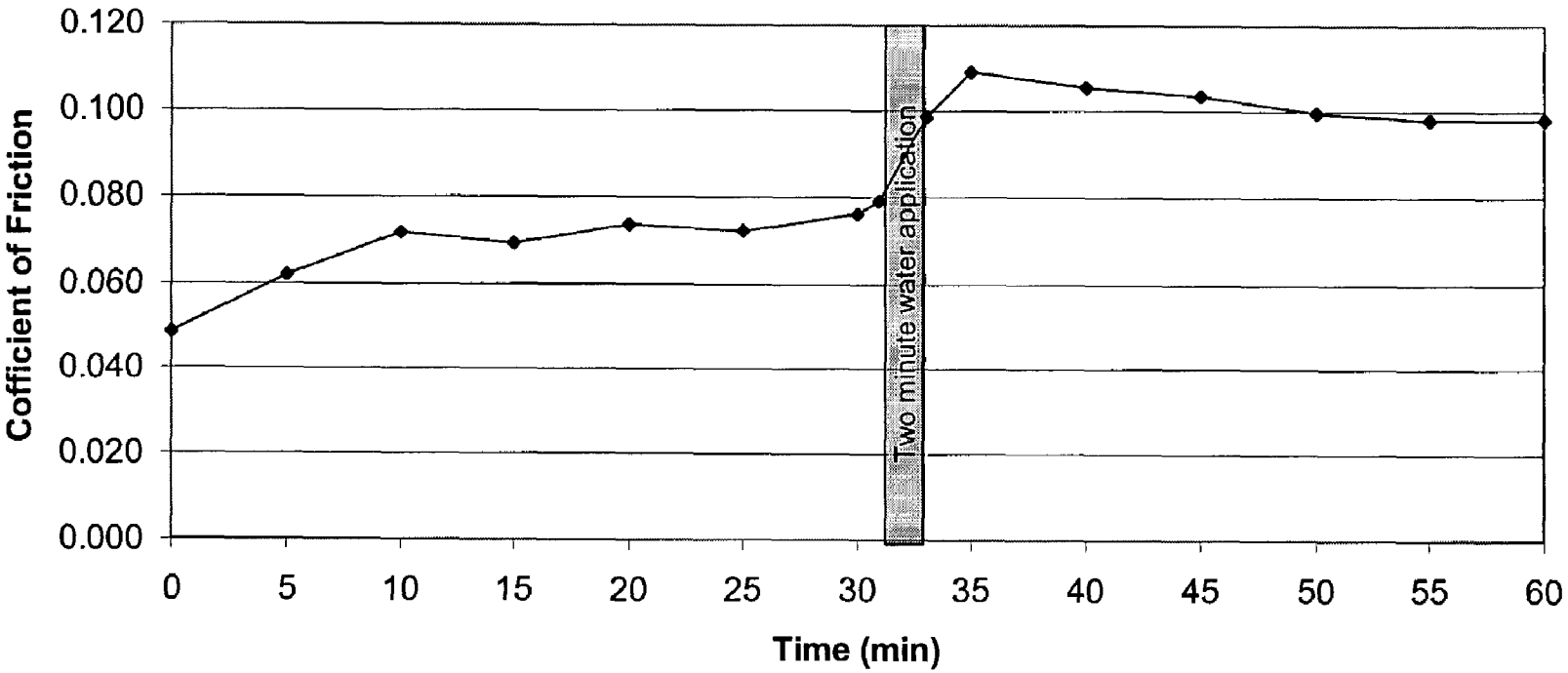
FIG. 3 shows a graph of the coefficient of friction versus time, measured according to the short track conveyor test, for the formulation of Example 2.

The polyurethane-based composition was applied to a short track conveyor as described in Example 1. The composition was applied using a manual spray applicator in an amount of 0.8 to 2.2 mg/cm$^2$ until approximately 6.8 grams had been applied. The composition was then allowed to cured for about 1 hour, until dry to the touch. The total weight of the bottles and the load cell loop was about 2787 grams. The coefficient of friction for the resulting coating was measured under both wet and dry conditions as described in Example 1. As shown in FIG. 3, the coefficient of friction for bottles on the coated conveyor belt ranged from about 0.05 to about 0.08 under dry conditions. The measured coefficient of friction for the coating under wet conditions ranged from about 0.08 to 0.11.

As will be understood by one skilled in the art, for any and all purposes, particularly in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third, and upper third, etc. As will also be understood by one skilled in the art, all language such as "up to," "at least," "greater than," "less than," and the like, include the number recited and refer to ranges which can be subsequently broken down into sub-ranges as discussed above.

It is understood that the invention is not confined to the particular embodiments set forth herein as illustrative, but embraces all such forms thereof as come within the scope of the following claims.

What is claimed is:

1. A method for lubricating a conveyor for transporting a container, the method comprising applying a liquid composition to at least a portion of a conveyor part that comes into contact with the container and allowing the liquid composition to dry into a solid or semi-solid coating to form a substantially water-repellent, lubricating coating on at least a portion of the conveyor part, the liquid composition comprising at least one hydrophobic polymer, at least one alkali soluble resin and at least one wax, wherein at least one of the hydrophobic polymer or the alkali soluble resin is polymerized from monomers that include (a) styrenic monomers and (b) at least one monomer selected from the group consisting of acrylate monomers, methacrylate monomers, methacrylic acid monomers and acrylic acid monomers.

2. The method of claim 1, wherein the coating comprises at least 10 weight percent wax based on the solid material content of the coating.

3. The method of claim 1, wherein the coating comprises greater than 50 weight percent wax based on the solid material content of the coating.

4. The method of claim 1, wherein the coating comprises at least 40 weight percent of the at least one hydrophobic polymer based on the solid material content of the coating.

5. The method of claim 1, wherein the at least one hydrophobic polymer is polymerized from styrenic and acrylate or methacrylate monomers.

6. The method of claim 5, wherein the alkali soluble resin is polymerized from styrenic and acrylic acid or methacrylic acid monomers.

7. The method of claim 1, wherein the liquid composition further comprises a fluoropolymer.

8. The method of claim 1, wherein the wax comprises carnauba wax.

9. The method of claim 1, wherein the liquid composition further comprises at least one additive selected from defoaming agents, anti-microbial agents, pigments, surfactants, wetting agents, and Zn oxide.

10. The method of claim 1 further comprising reapplying the liquid composition to at least a portion of the conveyor part to repair the lubricating coating.

11. The of claim 1, wherein the lubricating coating, as applied, has a coefficient of friction of less than 0.15, as measured by a short track conveyor test.

12. The method of claim 11, wherein the lubricating coating, as applied, has a coefficient of friction of less than about 0.14 as measured by a short track conveyor test.

13. The method of claim 1, wherein the wax makes up at least 5 weight percent of the coating based on the solid material content of the coating.

14. The method of claim 1, wherein the alkali soluble resin has a number average molecular weight of no more than about 20,000 and the hydrophobic polymer has a number average molecular weight of at least about 30,000.

15. The method of claim 1, wherein the ratio of the alkali soluble resin to the hydrophobic polymer is from about 70:30 to 30:70.

16. A conveyor for transporting a container, at least a portion of a part of the conveyor coated with a solid or semi-solids, substantially water-repellent, lubricating coating comprising at least one hydrophobic polymer, at least one alkali soluble resin and at least one wax, wherein at least one of the hydrophobic polymer or the alkali soluble resin is polymerized from monomers that include (a) styrenic monomers and (b) at least one monomer selected from the group consisting of acrylate monomers, methacrylate monomers, methacrylic acid monomers and acrylic acid monomers.

17. The conveyor of claim 16 wherein the coating has a coefficient of friction of less than 0.15, as measured by a short track conveyor test.

18. The method of claim 1, wherein the styrenic monomers are selected from the group consisting of styrene and methyl styrene monomers, and the acrylate monomers are butyl acrylate monomers.

19. The method of claim 1, wherein the at least one hydrophobic polymer is polymerized from styrene, methyl styrene, butyl acrylate, and methacrylic acid and the at least one alkali soluble resin is polymerized from styrene, methyl styrene, and acrylic acid.

20. The conveyor of claim 16, wherein the at least one hydrophobic polymer is polymerized from styrene and acrylate or methacrylate monomers.

21. The conveyor of claim 20, wherein the alkali soluble resin is polymerized from styrene and acrylic acid or methacrylic acid monomers.

22. The conveyor of claim 16, wherein the styrenic monomers are selected from the group consisting of styrene and methyl styrene monomers, the acrylate monomers are butyl acrylate monomers, and the methacrylate monomers are methacrylate monomers.

23. The conveyor of claim 16, wherein the at least one hydrophobic polymer is polymerized from styrene, methyl styrene, butyl acrylate, and methacrylic acid and the at least one alkali soluble resin is polymerized from styrene, methyl styrene, and acrylic acid.

24. A method for lubricating a conveyor for transporting a container, the method comprising applying a liquid composition to at least a portion of a conveyor part that comes into contact with the container and allowing the liquid composition to dry into a solid or semi-solid coating to form a substantially water-repellent, lubricating coating on at least a portion of the conveyor part, the liquid composition comprising at least one hydrophobic polymer, at least one alkali soluble resin and at least one wax, wherein the at least one hydrophobic polymer and the at least one alkali soluble resin do not undergo polymerization or crosslinking after application to the conveyor part.

25. The method of claim 24, wherein the coating comprises at least 10 weight percent wax based on the solid material content of the coating.

26. The method of claim 24, wherein the coating comprises greater than 50 weight percent wax based on the solid material content of the coating.

27. The method of claim 24, wherein the coating comprises at least 40 weight percent of the at least one hydrophobic polymer based on the solid material content of the coating.

28. The method of claim 24, wherein the wax comprises carnauba wax.

29. The method of claim 24, wherein the liquid composition further comprises at least one additive selected from defoaming agents, anti-microbial agents, pigments, surfactants, wetting agents, and Zn oxide.

30. The method of claim 24, wherein the coating, as applied, has a coefficient of friction of less than about 0.14 as measured by a short track conveyor test.

31. The method of claim 24, wherein the alkali soluble resin has a number average molecular weight of no more than about 20,000 and the hydrophobic polymer has a number average molecular weight of at least about 30,000.

32. The method of claim 24, wherein the ratio of the alkali soluble resin to the hydrophobic polymer is from about 70:30 to 30:70.

* * * * *

UNITED STATES PATENT AND TRADEMARK OFFICE

CERTIFICATE OF CORRECTION

PATENT NO. : 7,091,162 B2
APPLICATION NO. : 10/613504
DATED : August 15, 2006
INVENTOR(S) : Paul F. Lewis and Jim J. Hilarides It is certified that error appears in the above-identified patent and that said Letters Patent is hereby corrected as shown below:

IN THE DRAWINGS:

Page 4, Sheet 2, Figure 2: Delete the phrase "C fficient of Friction" and insert --Coefficient of Friction--.

Page 5, Sheet 3. Figure 3: Delete the phrase "Cofficient of Friction" and insert --Coefficient of Friction--.

IN THE SPECIFICATION:

Column 5, Line 23: Delete "camauba" and insert --carnauba--.

IN THE SPECIFICATION:

Column 5, Line 30: Delete "camauba" and insert --carnauba--.

Column 8, Line 28, Table 4: Delete " Aguaslip" and insert --Aquaslip.--.

IN THE CLAIMS:

Column 9, Line 40, Claim 11: Delete the phrase "The of claim" and insert --The method of claim--.

IN THE CLAIMS:

Column 9, Line 58, Claim 16: Delete the word "semi-solids," and insert --semi-solid,--.

Signed and Sealed this

Third Day of April, 2007

JON W. DUDAS
*Director of the United States Patent and Trademark Office*